US006253417B1

(12) United States Patent
Rusiana

(10) Patent No.: US 6,253,417 B1
(45) Date of Patent: Jul. 3, 2001

(54) DOOR HOLDER AND STOP WITH RETAINING MEANS FOR HOLDING A DOOR SHUT WHILE IN A CLOSED POSITION

(75) Inventor: Arturo D. Rusiana, Algonquin, IL (US)

(73) Assignee: Architectural Builders Hardware Mfg., Inc., Elk Grove Village, IL (US)

( * ) Notice: Subject to any disclaimer, the term of this patent is extended or adjusted under 35 U.S.C. 154(b) by 0 days.

(21) Appl. No.: 09/409,544

(22) Filed: Sep. 30, 1999

(51) Int. Cl.[7] ..... E05F 5/02; E05F 1/00

(52) U.S. Cl. ..... 16/82; 16/65; 16/71; 16/85; 292/251.5

(58) Field of Search ..... 16/82, 80, 85, 16/86 B, 70, 71, 72, 65, 49, DIG. 10; 49/394, 407; 292/251.5, 262, 277

(56) References Cited

U.S. PATENT DOCUMENTS 2,277,316 * 3/1942 Garrison ..... 16/DIG. 10
2,744,779 * 5/1956 Ellis ..... 292/275
3,144,267 * 8/1964 Schmid ..... 292/278
3,630,560 * 12/1971 Atkins ..... 292/270
4,506,407 * 3/1985 Downey ..... 16/48.5
4,751,766 * 6/1988 Fahs et al. ..... 16/86 B
4,858,272 * 8/1989 Ogawa et al. ..... 16/80
5,010,622 * 4/1991 Morita ..... 16/85
5,381,628 1/1995 D'Hooge .
5,906,026 * 5/1999 Junttila ..... 16/85

* cited by examiner

*Primary Examiner*—Chuck Y. Mah
(74) *Attorney, Agent, or Firm*—Greer, Burns & Crain. Ltd.

(57) ABSTRACT

A door holder and stop which utilizes an elongated arm and track to retain the door in a closed position. The arm, through the use of a plate, is attached to a door frame. Pivotally and slidably connected to the arm is the track, having a return end and a closure end. The track is fixably attached to a door. At one end, the track has a locking mechanism for retaining the door in a closed position.

18 Claims, 3 Drawing Sheets

DOOR HOLDER AND STOP WITH RETAINING MEANS FOR HOLDING A DOOR SHUT WHILE IN A CLOSED POSITION

FIELD OF THE INVENTION

The present invention relates generally to door holders and stops having retaining mechanisms for holding doors shut while in a closed position. More specifically, the invention concerns a door holder and stop, with an arm and a track, that uses magnetic force to hold a door shut while in the closed position.

BACKGROUND OF THE INVENTION

Presently, door holders and stops are known for keeping doors held open at a predetermined angle. The known door holders and stops include an arm, one end of which is pivotally attached to a slide. The other side is attached to a door frame. A channel located in a track, which is attached to a door, provides a guideway for the slide. Normally, on one end of the track, there is a thumb wheel positioned to rotate to engage or disengage a pawl against a hook, which is on the slide. The pawl and the hook provide a locking mechanism for locking the slide against further movement on the track. In this manner, the door is held in an open position. Although this is helpful in some instances, there is no mechanism on the door stop for keeping the door shut in a closed position.

Also previously known are many types of door latch mechanisms. The most well known door latch mechanisms include the traditional reciprocating latch bolt type, where a door knob is rotated to unlatch a latch bolt, or a push down type where handle is pushed down to unlatch the latch bolt. Installation of a standard door latch can include drilling a first hole through the thickness of the door for the door knob and drilling a second hole perpendicular to the first hole for the latch mechanism. Also, part of the door frame may need to be mortised and chiseled away to properly position a receiving plate for the latch. Once the drilling is finished, installation of the actual latch can begin and involves fastening various portions of the door latch in place, and making exact measurements as to where the door latch will be. This is an exacting process that can be difficult to master and is time consuming. Therefore, there is a need for a door retaining mechanism that is easy to install and use.

A first object of the present invention to provide an improved door holder and stop which can hold doors shut while in a closed position.

Another object of this invention is to provide an improved retaining mechanism for a door which replaces a conventional reciprocating latch.

Finally, it is another object of this invention to provide an improved retaining mechanism for a door which is easy to operate and install.

SUMMARY OF THE INVENTION

These and other needs are met or exceeded by the present door holder and stop that uses a retaining mechanism to hold a door shut while in a closed position. One end of an arm is slidably and pivotally attached to a track. Another end of the arm is attached, via an attachment plate, to one of a door and a door frame. The track is mounted onto the other of the door and door frame. During operation of the door, the arm slides along the length of the track. On one end of the track, a retaining mechanism is located which acts to hold the door shut when it is in a closed position.

More specifically, a door holder and stop are provided, including an elongated arm having a first end and a second end, and a first attachment mechanism for pivotally attaching the first end of the arm to one of a door and a door frame. An elongated track, pivotally and slidably attached to the arm, has a return end and a closure end, and is attached to the other of the door and the door frame. One of the return end and the closure end have a retaining mechanism for retaining the door in a closed position when the door is shut.

In the preferred embodiment, the track includes a channel which runs longitudinally through the track from the return end to the closure end. Within the channel is a slide, with a first end and a second end, and which is slidable along the channel and pivotally attached to the arm. Fixably attached in the channel at one end is a magnet, preferably at the closure end. One of the first end and the second end of the slide is attached to a magnet surface, such that the magnet will attract the surface when the door is in the closed position. Preferably, the magnet surface includes a magnet plate and a fastener countersunk into the plate and is located at the second end of the slide. The fastener acts as an adjusting mechanism for adjusting a relative distance between the plate and the second end of the slide. Also included is a spring to bias the magnet surface against the second side of the slide.

Also included in the preferred embodiment is a door holder and stop which includes the retaining mechanism at the closure end of the track and a mechanism for holding a door open at a predetermined angle located at the return end. The opening mechanism uses a standard pawl and hook device to lock the door in an open position. Preferably, the pawl is located on the return end of the track and is engageable with the hook, which is located on the first end of the slide. Once the hook and pawl are engaged, the door is then held in an open position. A spring is located within the slide at the first end and acts to bias the hook in a downward position. However, a user may unlock the hook and pawl by jiggling the door, which works against the spring and lifts the hook off of the pawl.

The pawl mechanism may also be rotated by use of a thumb wheel so that it does not engage the hook. This advantage allows the user to open the door fully without the door locking open at a predetermined angle. Since the pawl is held in the channel by a fastener, the user may completely remove the pawl. Removal of the pawl may be accomplished after the track has been installed, thereby allowing the user to easily add and remove the pawl without the trouble of having to reattach the whole door holder and stop.

DETAILED DESCRIPTION OF THE INVENTION

Figure 1:
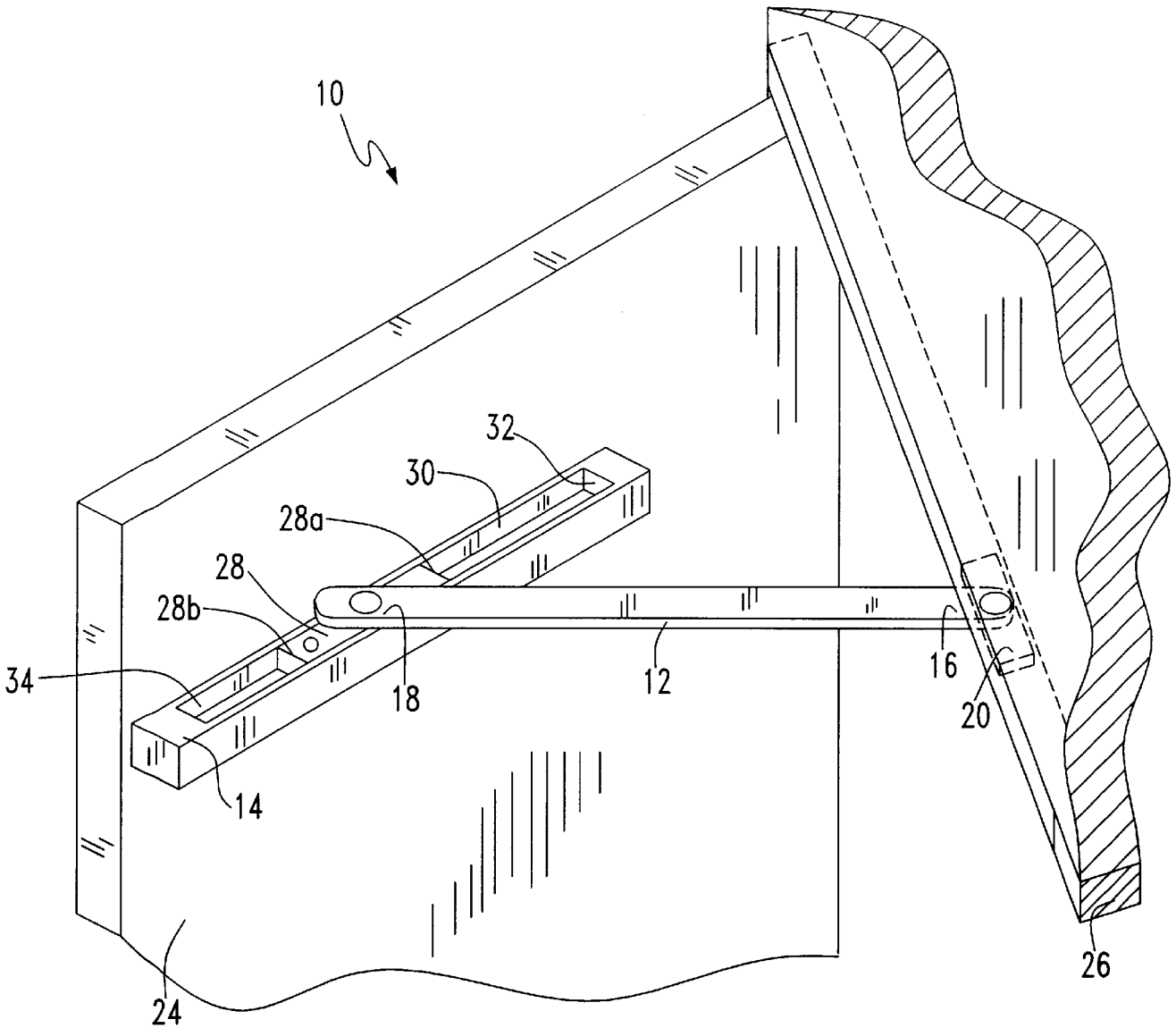
FIG. 1 is a fragmentary perspective view of the present door holder and stop.

In FIG. 1, a general drawing of the preferred embodiment is depicted. A door holder and stop, generally designated 10, includes an arm 12 and a track 14, which are well known in the art. The arm 12 has a first end 16 and a second end 18. Pivotally attached to the first end 16 is an attachment plate 20. The plate 20 has a plurality of holes 22 (shown in FIG.

2) to securely attach the arm 12 to either a door 24 or a door frame 26. In the preferred embodiment, the arm 12 is attached to the door frame 26.

Figure 2:
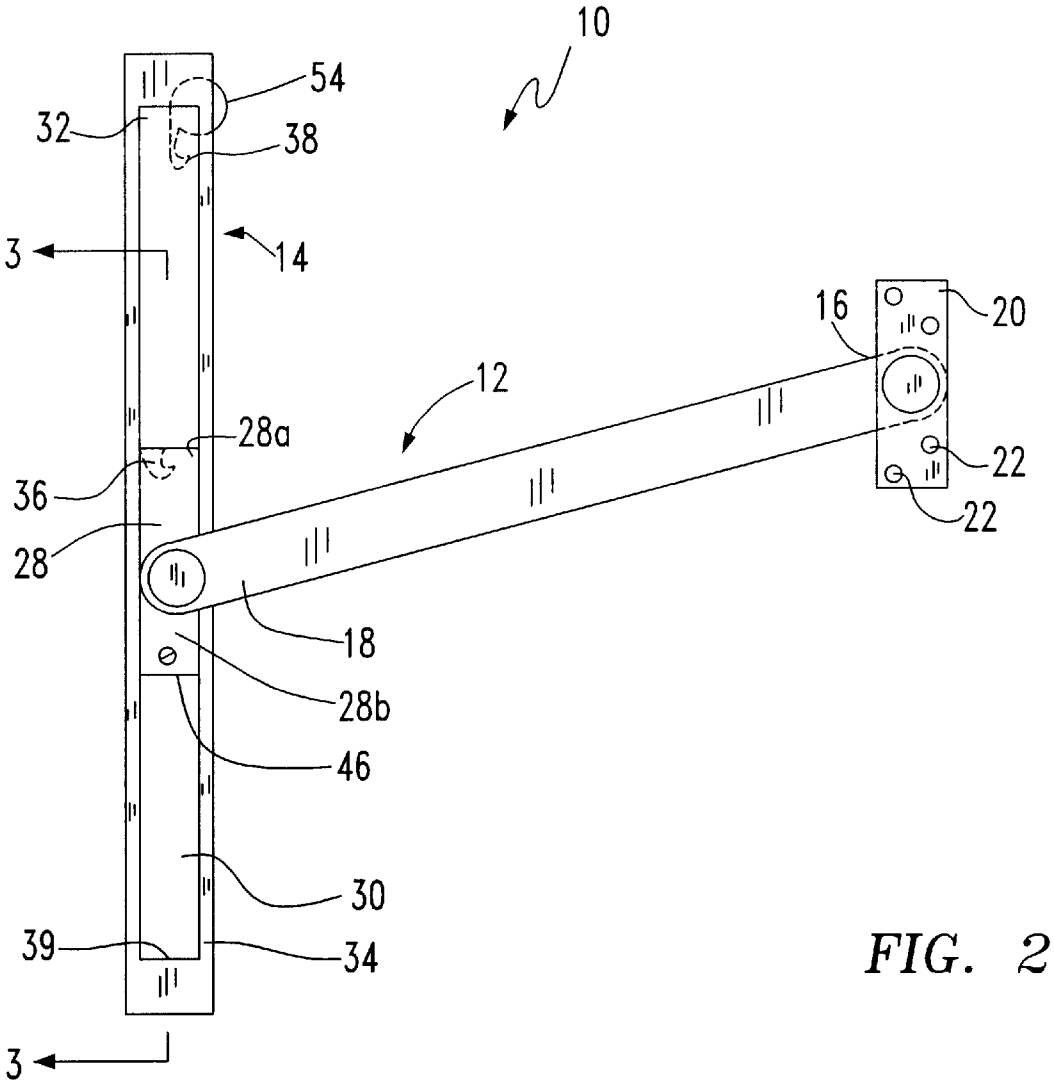
FIG. 2 is a top view of the present door holder and stop.

Referring now to FIGS. 1 and 2, the arm 12 is attached to the track 14 via a slide 28, which has a first end 28*a* and a second end 28*b*. The slide 28 slides along the length of the track 14 through an open topped channel 30, which is defined by the track 14. In the preferred embodiment, the channel 30 and the slide 28 have a width of approximately 0.6 to 0.7 inches, and the slide 28 also has a length of approximately 3.4 to 3.5 inches. However, other dimensions are contemplated depending on the application. Also included in the track 14 are a return end 32 and a closure end 34.

As the door 24 moves between an open position, where the first end 28*a* is adjacent to the return end 32, and a closed position, where the second end 28*b* is adjacent to the closure end 34, the arm 12 pivots and causes the slide 28 to move through the channel 30 between the return end 32 and the closure end 34 of the track 14. The arm 12 is attached to the slide 28 by a pivot pin 56 (best shown in FIG. 3) which allows the arm to pivot as the arm is moved by the door 24. Shown hidden in FIG. 2 are a hook 36 and a pawl 38, which will be described more clearly below with reference to FIG. 3.

Also shown in FIG. 2 is a magnet surface 46 located on the second end 28*b* of the slide 28. As the slide 28 moves through the channel 30 and towards the closure end 34 of the track 14, the magnet surface 46 encounters a retaining mechanism, generally designated 39, located at the closure end of the track 14.

Figure 3:
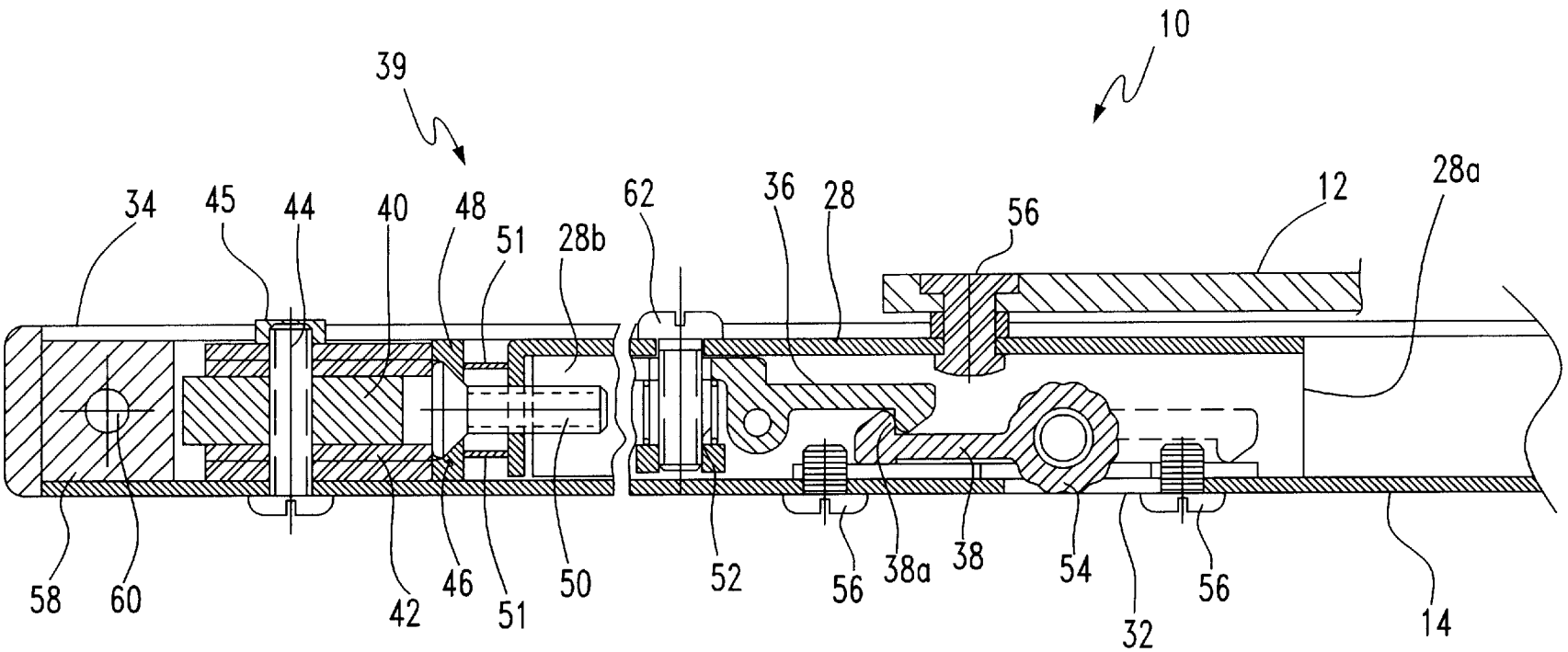
FIG. 3 is a fragmentary section taken along the line 3—3 of FIG. 2 and in the direction indicated generally.

Turning now to FIG. 3, the retaining mechanism 39 for holding the door 24 in a closed position with the door frame 26, is located at the closure end 34 of the track 14, although other locations are contemplated. In the preferred embodiment, the retaining mechanism 39 includes a magnet 40. The magnet 40 is held sandwiched between plates of a steel lamination 42 by a fastener 44, which, in turn, is held in place by a square nut 45. Naturally, other known fastening technologies are contemplated such as cotter pins, rivets, adhesives, etc. The magnet 40 magnetizes the steel lamination 42 so that the lamination has a magnetic force. It is also contemplated that just the magnet 40 may be used, without the steel lamination 42, or that other equivalent arrangements which provide a magnetized surface may be used.

The magnet 40 is preferably made with an approximate width of 0.550 to 0.570 inches, a length of about 1.040 to 1.050 inches and a thickness of approximately 0.280 to 0.300 inches. Abutting the magnet 40, the steel lamination 42 preferably has a length of approximately 1.040 to 1.050 inches, a width of about 0.610 to 0.620 inches, and a thickness of between about 0.1640 to 0.0750 inches. The above dimensions may change to suit the application.

Located on the second end 28*b* of the slide 28 is the magnet surface 46. In the preferred embodiment, the magnet surface 46 is found on a magnet plate 48. Into the magnet plate 48, a flatheaded fastener 50 is countersunk. The fastener 50 and the magnet plate 48 thus form a flat surface which is attracted to the magnetic force provided by the steel lamination 42. Since the fastener 50 and the magnet plate 48 form a flat surface, the magnetic force acts on the surface evenly, providing a better hold. In the preferred embodiment, the fastener 50 is a screw, however, other known fastening technologies, such as those mentioned above, are contemplated.

Also included is a compression spring 51 which is located between the fastener 50 and the slide second end 28*b*, to bias the fastener 50 away from the second end 28*b* of the slide 28. The relative distance between the fastener 50 and the second end 28*a* of the slide 28 can be adjusted by threading the fastener 50 into or out of the slide second end 28*b*.

When the magnet surface 46 is brought into close contact with the steel lamination 42, the magnetic force pulls the magnet surface and effectively retains the magnet surface near the steel lamination. This magnetic attraction holds the slide 28 at the closure end 34 of the track 14, retaining the door 24 in a closed position.

The magnetic hold can be broken by a sharp push on the door 24. Enough pressure on the door 24 will counteract the magnetic force and the slide 28 will move away from the closure end 34, allowing the door 24 to be opened easily. This allows the user to easily close a door and retain the door in the closed position. Also, since the force is broken by a push, the door can be opened easily. To adjust the amount of force needed to open the door 24, the fastener 50 is adjusted so that the magnet surface 46 is closer to or farther from the lamination 42. The above-described features are improvements over prior door latch mechanisms, which require turning or pushing a knob, and/or also require a significantly greater amount of latch hardware and labor for assembly. A door equipped with the door holder and stop of the present invention can be opened easily without using one's hands (for example doctors, who cannot touch the door with their hands) and only requires a push.

Also located at both the closure end 34 and the return end 32 of the track 14 is an end plug 58. The end plug 58 is fixed in the track 14, and acts as a stopper and defines the ends of the channel 30. By threading a fastener 60 through the end plug 58 and into the door 24, the door holder and stop 10 is more securely held onto the door. Generally, the end plug 58 is constructed of solid steel, although other materials are contemplated.

Referring again to FIGS. 2 and 3, the door holder and stop 10 of the first embodiment is preferably further equipped with a mechanism for holding the door 24 in an opened position at a predetermined angle. As shown in FIG. 2, the hook 36 and the pawl 38 are located on the slide 28 and the track 14, respectively. Preferably, the hook 36 is located on the first end 28*a* of the slide 28, although other locations are contemplated. The pawl 38 is located on the return end 32 of the track 14. The construction and dimensions of these components are the same as in a conventional door holder and stop that uses such a mechanism to retain a door in an open position.

As the slide 28 moves toward the return end 32 of the track 14, the hook 36 is held in a downward position by a compression spring 52. A fastener 62 is located in the slide 28 to hold the spring 52 in place. When the hook 36 abuts the pawl 38 (best seen in FIG.3), the hook moves about a pivot point 64 and engages the pawl. Once the hook 36 and pawl 38 are engaged, the door 24 cannot be opened any farther and will be held in that position until dislodged. With a slight push or jiggle of the door 24, the user can counteract the force of the spring 52 and cause the hook 36 to rotate about its pivot point 64 and disengage from the pawl 38.

Also located on the pawl 38 is a thumb wheel 54 which protrudes through the bottom of the track 14. With this thumb wheel 54, the user can rotate the unlatched pawl 38 180° (as shown in phantom on FIG. 3). An engaging end 38*a* of the pawl 38 rotates through an open upper end 31 of the channel 30 when the slide 28 is moved away, such as to the closed position. This allows the user to open the door 24 fully without locking it at a certain position. The entire pawl 38 mechanism, including the thumb wheel 54 may be removed if the user so desires. In the preferred embodiment, at least one fastener 66 is used to hold the pawl 38 in the track 14. The fastener 66 can be loosened and the pawl 38 can be removed, which also allows the user to fully open the door 24 without locking it at a certain position. The pawl 38 can be removed even while the track 14 is attached to the door 24, allowing for a user to easily switch between the options of holding the door open or allowing the door to open and close freely.

As demonstrated, the current invention is an improvement over prior art door restraining or latching mechanisms. The present door holder and stop can be installed easily into any standard door and door frame by merely fastening the arm into the door frame and the track into the door. No complicated drilling and mortising are required, as in installing a conventional latch. Another advantage to the current invention is that it can also be used easily, staying closed with a push, and opening with a push. In the preferred embodiment, it allows a user to hold the door in an open position as well as shut in a closed position.

While various embodiments of the present invention have been shown and described, it should be understood that other modifications, substitutions and alternatives are apparent to one of ordinary skill in the art. Such modifications, substitutions and alternatives can be made without departing form the spirit and scope of the invention, which should be determined from the appended claims.

What is claimed is:

1. A door holder and stop comprising:

an elongated arm having a first end and a second end;

a first attachment means for pivotally attaching said first end of said arm to one of a door and a door frame;

an elongated track, pivotally and slidably attached to said arm, having a return end, a closure end and being attached to the other of the door and the door frame; and one of said return end and said closure end having a magnetic retaining means for retaining the door in a closed position when the door is shut.

2. The door holder and stop according to claim 1, wherein said retaining means comprises:

a channel, running longitudinally through said track, from said return end to said closure end;

a slide, slidable along said channel and pivotally attached to said arm, having a first end and a second end;

a magnet fixably attached in said channel;

a magnet surface, attached to one of said first end and said second end of said slide, such that said magnet will attract said surface when the door is in the closed position.

3. The door holder and stop according to claim 2, wherein said magnet surface further comprises:

a magnet plate;

a fastener countersunk into said magnet plate; and said plate being attached to one of said first end and said second end of said slide.

4. The door holder and stop according to claim 3, wherein said magnet surface of said slide further comprises an adjusting means for adjusting a relative distance between said plate and one of said first end and said second end of said slide.

5. The door holder and stop according to claim 4, wherein said magnet surface of said slide is biased against one of said first end and said second end of said slide.

6. The door holder and stop according to claim 1, wherein said track further comprises a channel running longitudinally through said track, from said return end to said closure end.

7. The door holder and stop according to claim 6, wherein said track further comprises a slide, slidable along said channel of said track, and pivotally attached to said arm, having a first end and a second end.

8. The door holder and stop according to claim 1, wherein said track further comprises a means for holding a door in an open position at a predetermined angle.

9. A door holder and stop comprising:

an elongated arm having a first end and a second end;

a first attachment plate for pivotally attaching said first end of said arm to one of a door and a door frame;

an elongated track, pivotally and slidably attached to said arm, having a return end and a closure end and attached to the other of said door and said door frame; and each of said return end and said closure end further comprising a locking mechanism for locking said door in one of an open position and a closed position, whereby said locking mechanism for locking said door in said closed position comprises magnetic force.

10. The door holder and stop according to claim 9, wherein one of said locking mechanisms comprises:

a channel, running longitudinally through said track, from said return end to said closure end;

a slide, slidable along said channel of said track and pivotally attached to said arm, having a first end and a second end;

a magnet fixably attached in said channel;

a magnet surface, such that said magnet will attract said surface when the door is in the closed position; and said magnet surface is attached to one of said first and said second ends of said slide.

11. The door holder and stop according to claim 10, wherein said magnet surface of said slide further comprises:

a magnet plate;

a fastener countersunk into said magnet plate; and said plate being attached to one of said first end and said second end of said slide.

12. The door holder and stop according to claim 11, wherein said magnet surface of said slide further comprises an adjusting mechanism for adjusting a relative distance between said plate and one of said first end and said second end of said slide.

13. The door holder and stop according to claim 12, wherein said magnet surface of said slide is biased against one of said first end and said second end of said slide.

14. The door holder and stop according to claim 9, wherein said track further comprises a channel running longitudinally through said track, from said return end to said second end.

15. The door holder and stop according to claim 14, wherein said track further comprises a slide, slidable along said channel of said track, and pivotally attached to said arm, having a first end and a second end.

16. A door holder and stop comprising:

an elongated arm having a first end and a second end;

a first attachment plate for pivotally attaching said first end of said arm to a door frame;

an elongated track, pivotally and slidably attached to said arm, having a return end and a closure end, a channel running longitudinally through said track, from said return end to said closure end, and said track being attached to a door;

a slide, slidable along said channel of said track and pivotally attached to said arm, having a first end and a second end;

each of said return end and said closure end having a locking mechanism for locking the door in one of an open position and a closed position;

said return end locking mechanism having a hook on said return end engaging a pawl on said first end of said slide, to lock the door in the open position at a predetermined angle; and said closure end locking mechanism comprising a magnet fixably attached in said channel, engaging a magnet surface on said second end of said slide, to lock the door in the closed position.

17. A door holder and stop comprising:

an elongated arm having a first end and a second end;

a first attachment means for pivotally attaching said first end of said arm to one of a door and a door frame;

an elongated track, pivotally and slidably attached to said arm, having a return end, a closure end and being attached to the other of the door and the door frame; and one of said return end and said closure end having a magnetic retaining means comprising a channel, running longitudinally through said track, from said return end to said closure end; a slide, slidable along said channel and pivotally attached to said arm, having a fist end and a second end; and a magnet fixably attached in said channel, for retaining the door in a closed position when the door is shut.

18. A door holder and stop comprising:

an elongated arm having a first end and a second end;

a first attachment plate for pivotally attaching said first end of said arm to one of a door and a door frame;

an elongated track, pivotally and slidably attached to said arm, having a return end and a closure end and attached to the other of said door and said door frame; and each of said return end and said closure end further comprising a locking mechanism comprising a channel, running longitudinally through said track, from said return end to said closure end; a slide, slidable along said channel of said track and pivotally attached to said arm, having a first end and a second end; a magnet fixably attached in said channel; a magnet surface, such that said magnet will attract said surface when the door is in the closed position; and said magnet surface is attached to one of said first and said second ends of said slide, for locking said door in one of an open position and a closed position, whereby said locking mechanism for locking said door in said closed position comprises magnetic force.

* * * * *